US009618296B2

(12) United States Patent
Rice

(10) Patent No.: US 9,618,296 B2
(45) Date of Patent: Apr. 11, 2017

(54) SLIDING IMPACT VALVE FOR PAINTBALL GUN

(71) Applicant: Jack V Rice, Placerville, CA (US)

(72) Inventor: Jack V Rice, Placerville, CA (US)

( * ) Notice: Subject to any disclaimer, the term of this patent is extended or adjusted under 35 U.S.C. 154(b) by 0 days.

(21) Appl. No.: 14/658,215

(22) Filed: Mar. 15, 2015

(65) Prior Publication Data

US 2016/0265870 A1 Sep. 15, 2016

(51) Int. Cl.
*F41B 11/72* (2013.01)
*F41B 11/721* (2013.01)

(52) U.S. Cl.
CPC ..... *F41B 11/721* (2013.01)

(58) Field of Classification Search
CPC ..... F41B 11/721; F41B 11/72; F41B 11/722; F41B 11/723; F41B 11/724
USPC ..... 124/73
See application file for complete search history.

(56) References Cited

U.S. PATENT DOCUMENTS 6,349,711 B1 * 2/2002 Perry ..... F41B 11/57 124/73
6,418,920 B1 * 7/2002 Marr ..... F41B 11/721 124/73
6,675,791 B1 * 1/2004 Alexander ..... F41B 11/62 124/71
7,150,276 B1 * 12/2006 Rice ..... F41B 11/62 124/73
7,258,114 B2 * 8/2007 Rice ..... F41B 11/50 124/72
7,490,598 B2 * 2/2009 Rice ..... F41B 11/71 124/77
8,833,351 B2 * 9/2014 Chen ..... F41B 11/70 124/61
2003/0047175 A1 * 3/2003 Farrell ..... F41A 11/06 124/76
2005/0126553 A1 * 6/2005 Rice ..... F41B 11/57 124/31
2006/0037597 A1 * 2/2006 Wood ..... F41B 11/721 124/73
2006/0107937 A1 * 5/2006 Rice ..... F41B 11/50 124/73
2006/0107938 A1 * 5/2006 Rice ..... F41B 11/71 124/73
2006/0107939 A1 * 5/2006 Dobbins ..... F41B 11/724 124/73
2006/0231084 A1 * 10/2006 Styles ..... F41A 7/08 124/74

(Continued)

*Primary Examiner* — Joshua Freeman
(74) *Attorney, Agent, or Firm* — Oakwood Law Group, LLP; Stephen Liu

(57) ABSTRACT

A innovative sliding valve used in paintball gun or other compressed gas propelled firearm, wherein a portion of the valve body where air is exhausted is reduced in size to allow pressurized air to exhaust more quietly around the valve body by feeding into the air exhaust apertures formed on an extended wall of valve body. Because the air pressure is balanced between two equal, or nearly equal, sized O-rings on a central spindle, the valve can be opened more smoothly and quietly, and with less opening force. Further, because the exhaust O-ring is contained with apertures and seals against the escaping air, with the resulting compression of the O-ring away from the sealing surface, the O-ring is held in place, and cutting and wear of the O-ring is substantially reduced.

14 Claims, 11 Drawing Sheets

(56) References Cited

U.S. PATENT DOCUMENTS

2007/0277798 A1* 12/2007 Bhogal ..... F41B 11/724
124/74
2013/0291848 A1* 11/2013 Wood ..... F41B 11/723
124/73

* cited by examiner

SLIDING IMPACT VALVE FOR PAINTBALL GUN

BACKGROUND OF THE INVENTION

Field of the Invention

The present invention relates to a valve used in compressed air gun, more particularly, to a sliding valve for paintball gun.

Description of Related Art

A paintball gun, also known as paintball marker, is now used in the sport of paintball. Paintball guns may use an expanding gas, such as carbon dioxide ($CO_2$) or compressed air, to propel paintballs through the barrel. The subject matter of present invention is an indispensable component for such paintball gun—the main valve.

The valve is a mechanical switch that controls firing. In Poppet-valve paintball guns, the main valve is in direct physical contact with hammer—additionally referred to as rammer, or striker in the art. Said direct contacting device or assembly is also coupled to a trigger. When the trigger is actuated, a hammer contacts the main valve, causing the main valve to open momentarily, thereby releasing high pressure air to travel into the firing chamber to fire the paintball.

A typical impact opening main valve has an end plate, or cap, overlying on the air inlet end which momentarily pops open when actuated. This motion causes the air to escape from around the edge of the cap as the cap moves away from the main valve body. The firing pressure causes resistance to opening the cap requiring significant impact pressure to open the valve assembly. Additionally a sheer pressure occurs upon opening, this snap air pressure, caused by the overlaying cap moving away from the valve body, results in a loud sound signature.

Therefore, a main valve with improved air flow to lower opening pressure and reduce firing noise is desirable.

Inventor has two issued U.S. Pat. No. 7,490,598 and U.S. Pat. No. 7,258,114. This application provides innovative elements to the main valve which was described in above mentioned patents.

SUMMARY OF THE INVENTION

In an exemplary embodiment of the present invention, there is disclosed a sliding valve utilized as a main valve in paintball gun or any type of compressed air propelled firearms.

In one preferred embodiment this sliding valve is aligned in the same bore with a ram assembly. A central spindle in the central bore of this valve receives actuation force on one end. High pressured air is delivered and stored in the middle of this valve assembly. On the other end of the spindle is an air pressure balancing piston, held within a cap. The axis of sliding valve and balancing cap are aligned. The central spindle slides between the valve body and the cap.

In this sliding valve body embodiment the valve body has a step down portion right where impact opening valve normally ends. This stepped down portion allows for high pressure air to flow around this additional, narrowed portion of the valve body. This narrowed portion having, additionally, air transfer apertures or grooves. The air is therefore now not allowed around a moving portion of a cap, rather it is diffused through the air transfer grooves as the piston moves to alternately expose and then seal these air transfer grooves.

As stated above, a connecting rod and a piston with O-ring, located in the front cap, is additionally included as a means of making the air pressure "balanced" (or more balanced) between the O-ring that selectively allows the air to flow through the valve body. An additional O-ring of substantially the same size balances the spindle between the valve and the front cap enabling spindle to slide easily and substantially without a bias being exerted by the pressure of the stored air.

By placing the sealing O-ring between the escaping air and the stored air, and having the sealing take place as the escaping air compresses the sealing O-ring into its designed groove, the O-ring is pushed away from the apertures that allow for air escapement, thereby minimizing potential for cutting of said sealing O-ring.

The more important features of the invention have thus been outlined. In order that the more detailed description that follows may be better understood, and in order that the present contribution to the art may better be appreciated. Additional features of the invention will be described hereinafter and will form the subject matter of the claims that follow.

Before explaining two main embodiments of the valve in detail: a Single Central Axis design with its inline bolt, and a Dual Parallel Axis design in which the valve is located in one bore and the bolt is located in a parallel bore; it is to be understood that the invention is not limited in its application to the details of construction and the arrangements of the components set forth in the following descriptions or illustrated in the drawings. The invention is capable of other embodiments and of being practiced and carried out in various ways. Also it is to be understood that the phraseology and terminology employed herein are for the purpose of description and should not be regarded as limiting.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
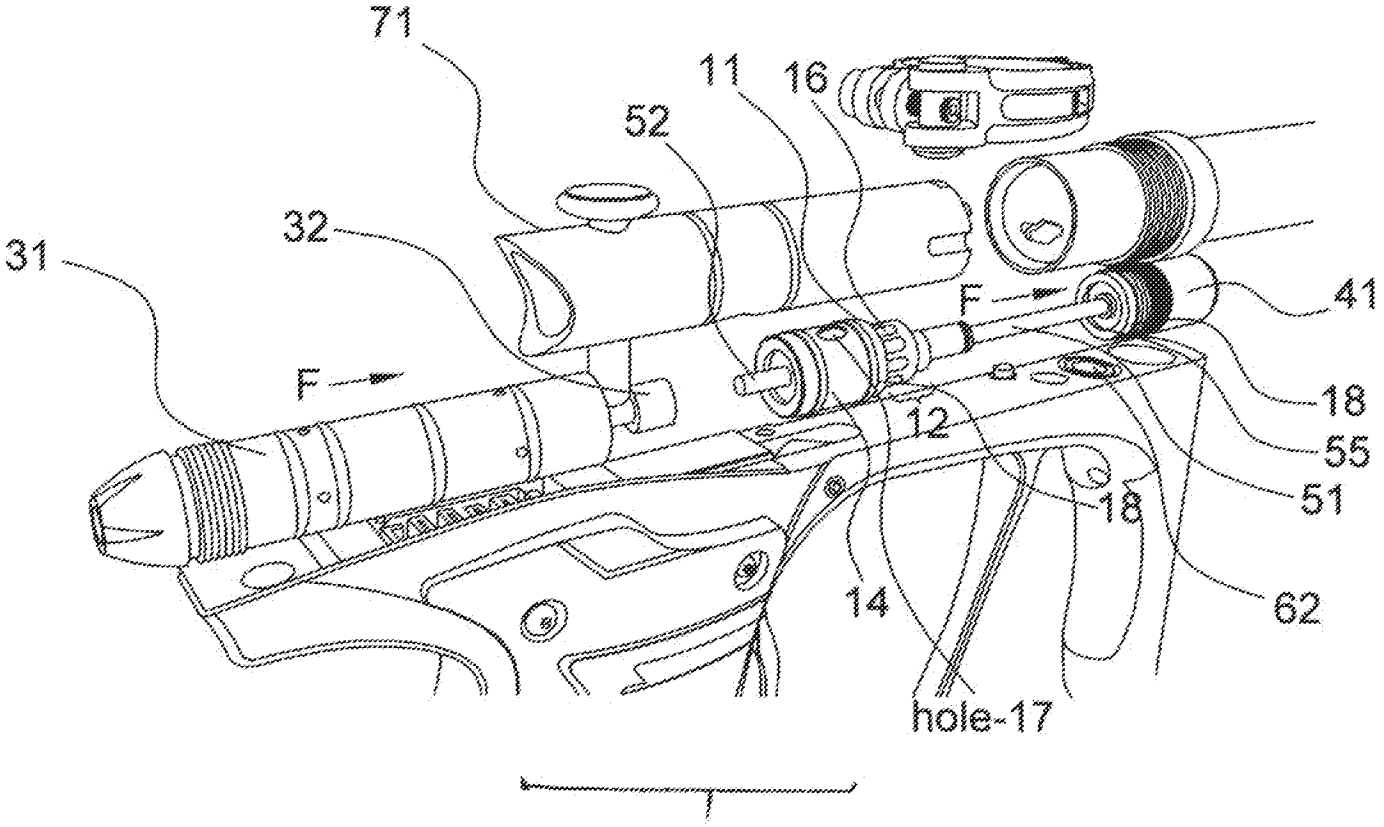
FIG. 1 is an explosive view of a paintball gun with sliding valve as used in a Dual Parallel Axis configuration, activated by an impact ram that, by means of a connection pin, also moves the bolt and showing its high pressured air source.

Referring to FIG. 1, there is disclosed a sliding valve in a Dual Parallel Axis configuration, with its partially revealed installation position in a paintball gun. Sliding valve assembly is show with valve body 14 at one end and a vented, air balancing front cap with central bore the majority of caps length 41 at the other. Sliding spindle 51 is held between said valve body 14, and said front cap 41. The hammer 32 of a ram assembly 31 is in line to actuation end 52 of said hammer 32 of said valve body 14. Hammer 32 strikes the spindle head 52 of valve assembly along the arrow F, moving the spindle shaft 51 towards the direction of said front balancing cap 41. High pressured air, shown entering through the grip frame 62, is stored within the gun body between O-rings 18; one of said O-rings 18 is located on said valve body 14, the other on said front cap 41. Said high pressure air is released through the plurality of apertures 16 located in extension of valve body 12 into central bore of main valve body 11, then redirected through extension of valve body 13 into a vertical bore 17. Inside said front cap 41, is preferably a spring (not shown) is held within said bore of said cap and front piston 55 of said sliding spindle 51 to bias said spindle into closed position at rest.

Figure 2:
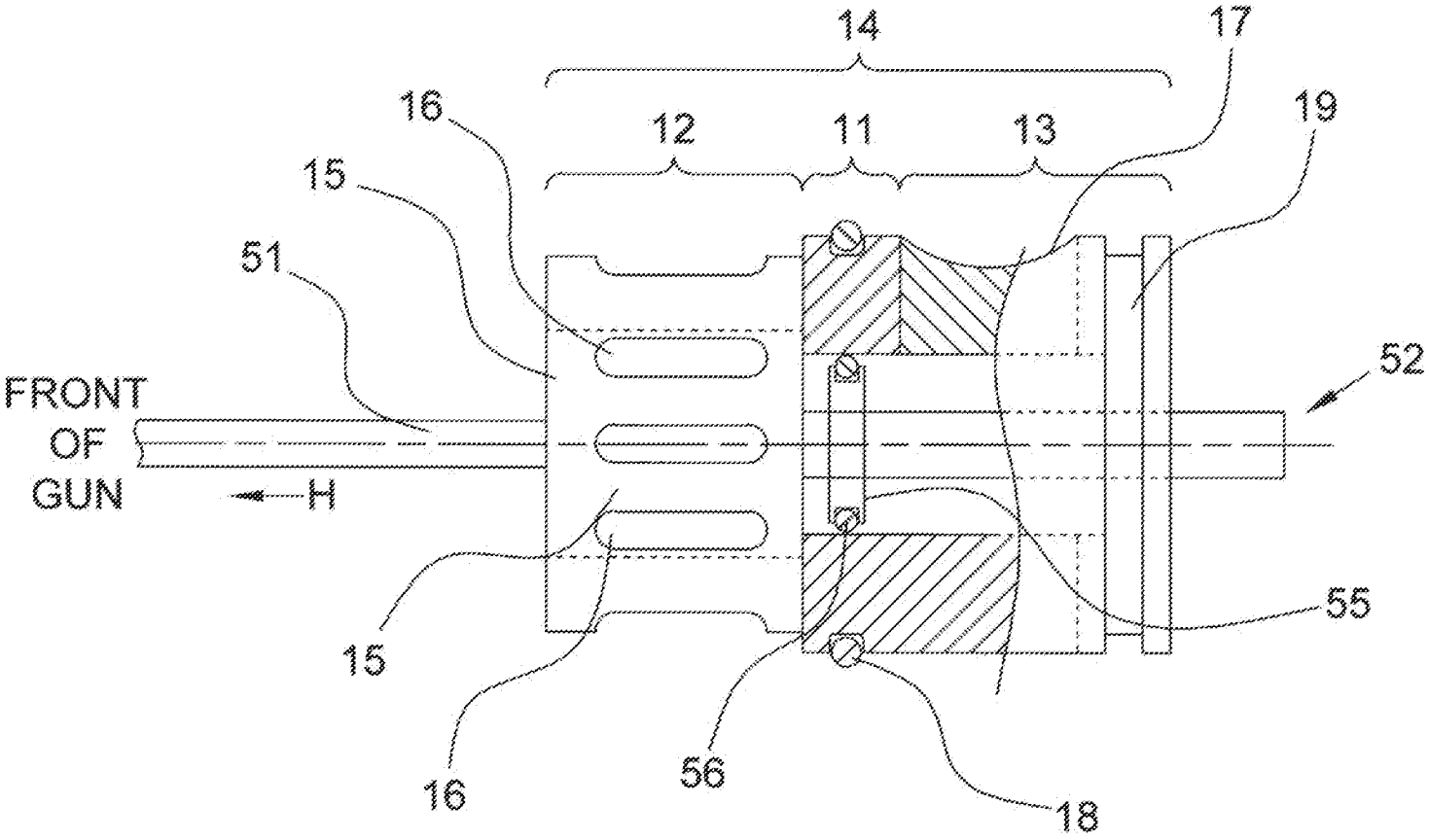
FIG. 2 is a perspective view of sliding impact valve body with its partially revealed first cylindrical portion according to a Dual Parallel Axis embodiment of present invention.

Referring to FIG. 2, discloses valve body 14 of valve assembly with one of the two piston 55 and O-ring 56 portions of the sliding spindle 51, and the impact receiving end 52 of said sliding spindle 51. Valve body 14 comprising of first cylindrical portion 11 and on one side of said first cylindrical portion 11 is air tightly adjacent a second cylindrical portion 12 with a plurality of apertures 16 that serve as air transfers for high pressure air stored between O-ring 18 and front cap 41 (seen in FIG. 1). Additionally air tightly attached on opposite side of 12 is an air redirection portion 13 designed to turn the air into a hole 17 which is bored perpendicularly to the longitude axis of said cylindrical extension portion 13 causing the air to be directed up and into the bolt assembly 71 (see FIG. 1) as is known in the art. When force is applied to said force end 52 of said spindle 51, said spindle travels along line indicated by arrow H. Movement of said piston and O-ring allowing High Pressure Air to exhaust through plurality of apertures 16, into central bore 15, then up bore 17, then into and through bolt 71 (See FIG. 1) and consequently causing the firing of the paintball. There are eight (8) apertures 16 formed on the wall of said second cylindrical portion 12 in a preferred embodiment of present invention.

Figure 3:
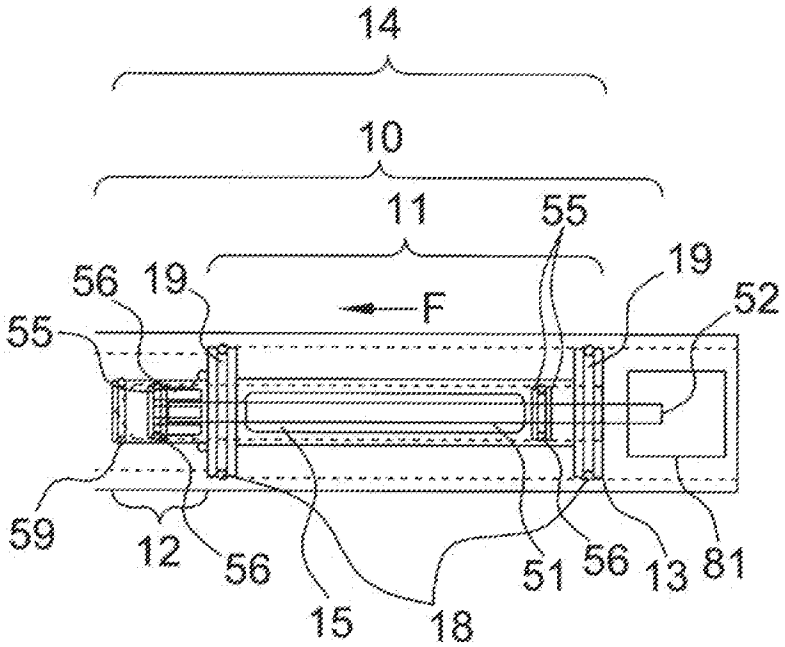
FIG. 3 is a view of sliding valve according to a Single Central Axis embodiment of present invention.

Referring to FIG. 3, discloses a Single Central Axis configuration of the present invention. Sliding valve assembly 10 is shown with sliding spindle 51. An actuator 81 pushes the end 52 of said sliding spindle 51 along the path shown as arrow F. Sliding spindle 51 moves towards the direction of the plurality of apertures 16. High pressured air supplied through grip frame 62 (not shows, see FIG. 1) is held in gun body and between O-rings 18 of valve body 14. When high pressure air flows through central bore 15 by means of said plurality of apertures 16, said high pressure air pushes bolt (Not shown, see FIGS. 8-10) forward until said bolt clears valve body O-ring 59, at which time the high pressure air flows through central bore of the bolt and fires the paintball. Said valve body 14 comprises a first cylindrical portion 11. On one side of said first cylindrical portion 14 is air tightly adjacent a second cylindrical portion 12 with a plurality of apertures 16 that serve as air transfers for the stored high pressure air. Sliding spindle 51 is shown within said valve body 14. Said sliding spindle 51 is show in its forward position. Said spindle slides by means of its activation end 52, into forward position allowing the high pressure air stored between the two O-rings 18 to flow down said center bore 15 of said valve body portions 11 and 12, and exhaust out the valve body through said apertures 16 to fire a paintball. There are eight (8) apertures 16 formed in the wall of said second cylindrical portion 12 in a preferred embodiment of present invention. Preferably a spring (not shown) is held between the front of said piston 55 and front wall of said extended portion 12 of said valve body 14 to bias said sliding spindle 51 into closed position at rest.

Figure 4:
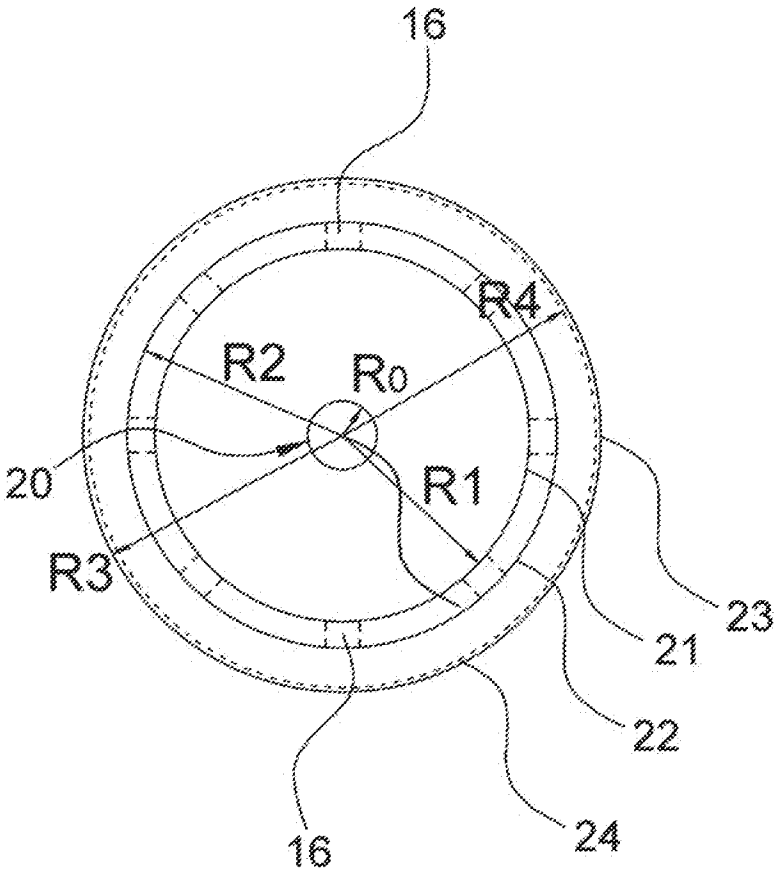
FIG. 4 is an end view of the valve body according to one embodiment of present invention.

Referring to FIG. 4, R0 refers to the radius of the central axis through bore 20 of valve assembly 10.

In a Dual Parallel Axis configuration of the present invention, the spindle activation end 52 (seen in FIG. 1 and FIG. 2) protrudes out of the valve body 14, by means of said R0 to receive force to actuate said valve assembly 10.

In Single Central Axis configuration R0 refers to a vent hole or through bore in end of extension 12, so that sliding spindle 51 (seen in FIGS. 3 and 11), can slide freely without becoming air locked R1 refers to the radius of the central bore 15 (seen in FIGS. 2 & 3), said bore extending the majority of the length of valve body 14.

R2 refers to the outer dimension of cylindrical extension portion 12.

R2 is larger than R1 so that a flange extension 12 is formed.

R3 refers to is the outside diameter 23 of valve body 14.

R4 refers to the outside diameter 24 of O'Ring groove for O-ring 18.

Note: the Single Central Axis configuration diameters' of R3 and R4 may be larger than the shown diameter in this preferred example of a Dual Parallel Axis configuration.

Figure 5:
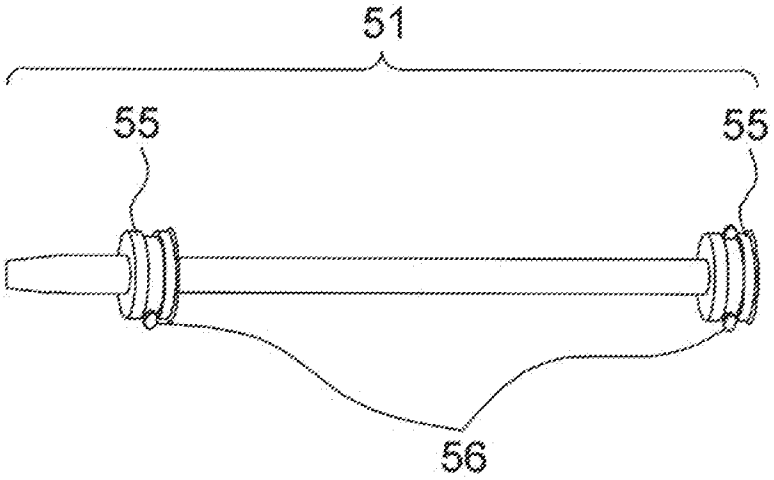
FIG. 5 is a perspective view of the sliding spindle only, according to both the Single Central Axis and the Dual Parallel Axis embodiment of present invention. In the Dual Parallel Axis embodiment, the O-ring closest to the extended activation end of the sliding spindle controls the air flow and the O-ring furthest balances the stored air. In the Single Central Axis embodiment, the O-ring furthest the activation end of the sliding spindle controls the air flow and the end closest to the activation end balances the stored air.
Figure 6:
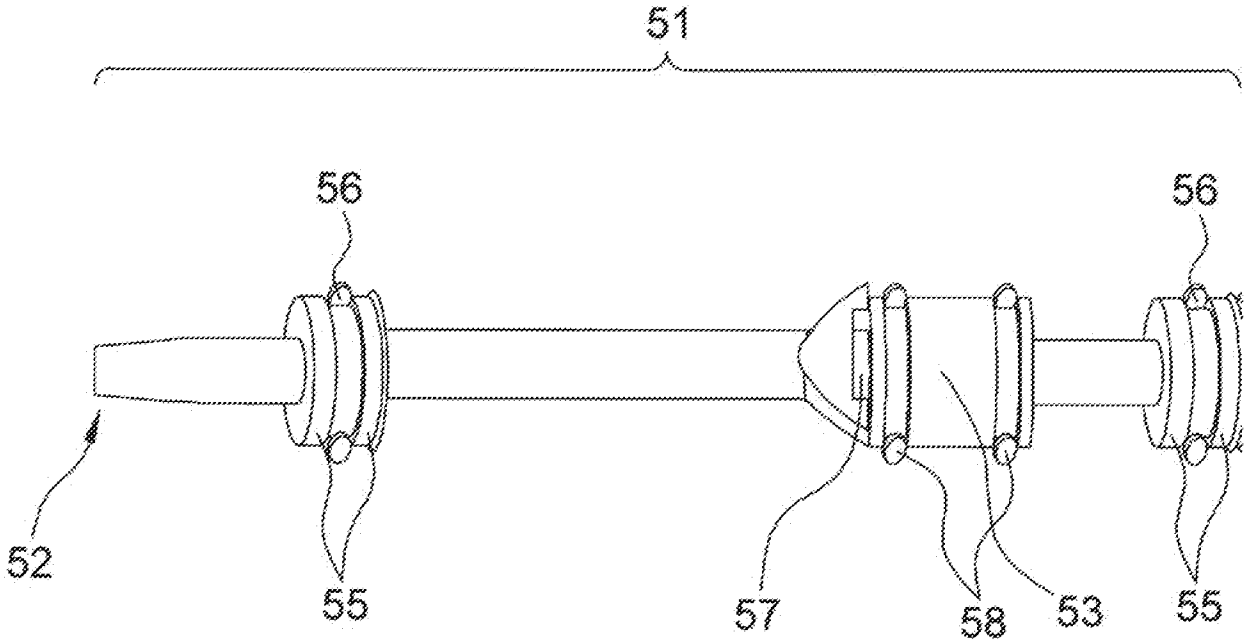
FIG. 6 is a perspective view of alternative design with an added middle drum air cutoff according to both shown embodiments of present invention.

Referring to FIG. 5 and FIG. 6, at least two O-rings 56 are configured to sit on the outer surface groove of the piston portions 55 of central sliding spindle 51 to seal the flow of air from said plurality of apertures 16 (see FIGS. 2 & 3), when said spindle is in its rest position. The combination of apertures 16, piston portions 55 and O-rings 56 control the air flow in the central bore of the valve body 14 (see FIGS. 2 & 3), while O-Rings 18 (see FIGS. 2 & 3), contain the stored air within the gun body. The equally sized, or nearly equally sized, pistons 55 and O'Rings 56 eliminates the excessive air pressure of previous designs in which the firing air held the cap closed, this configuration making the sealing air pressure "balanced" (or more balanced) for easier opening.

Referring to FIG. 6 an alternative embodiment of present invention is presented. Between raised pistons 55 a middle drum 53 acts as an air cutoff so that O-rings 58 located on said middle drum straddle the air bore 62 (see FIG. 1), which delivers high pressure air to storage area between O-rings 18. Said barrel 53 with O-rings 58 cuts off the incoming air so that the shot volume is limited and defined when valve assembly 10 slides open. 57 details a through bore(s) and escapement cut within and on said cutoff barrel that allows continuous communication of air in stored air portion of gun body.

Figure 7:
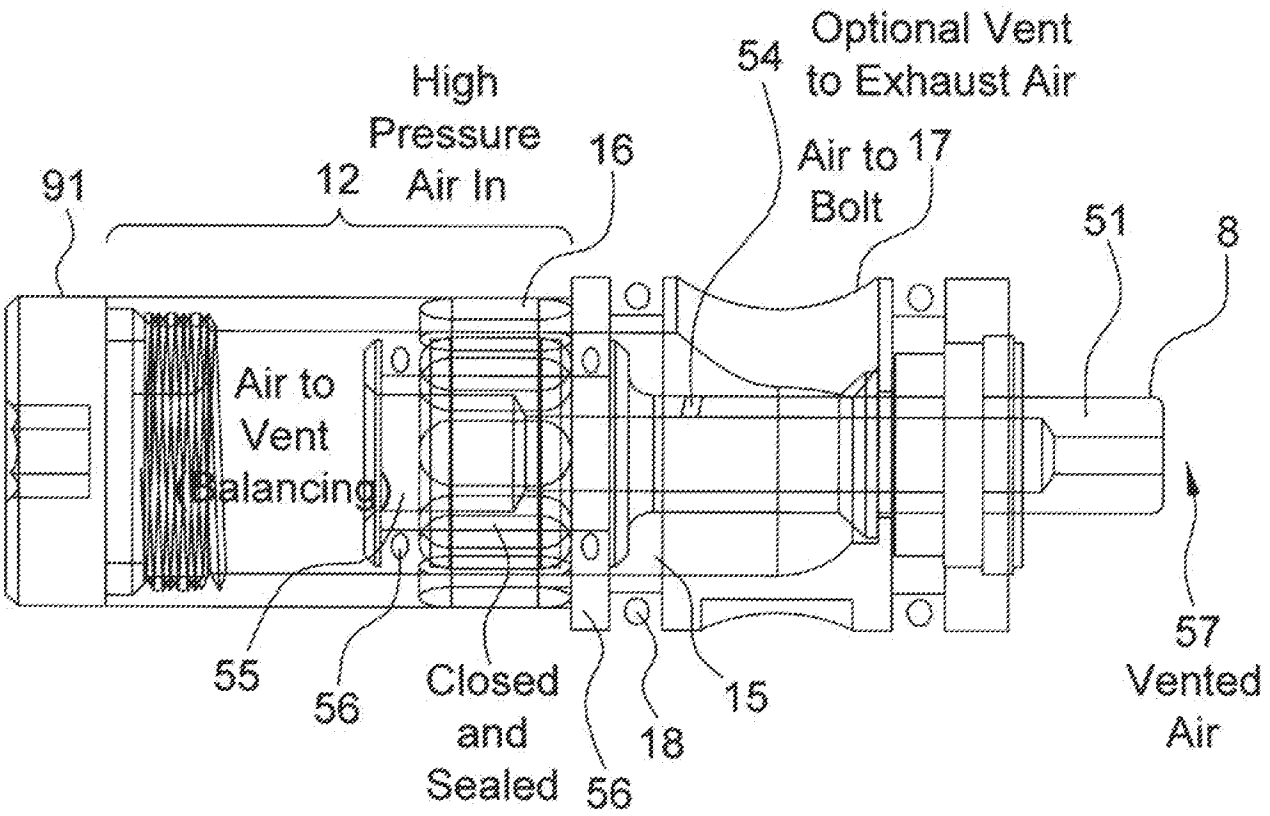
FIG. 7 is one Dual Parallel Axis version of the sliding valve with the balancing portion contained within an extended valve body, the venting feature now done through the central spindle.

FIG. 7 discloses an alternate embodiment of the present invention of Dual Parallel Axis configuration wherein the vented front cap 41 (see FIG. 1), originally containing the balancing piston 55 and O-ring 56, has said O'Ring 56 housed within a further extension 12 of the valve body. Venting of the air, for the purposes of making a balanced operation, is then accomplished through the activation portion of the sliding spindle, more precisely a bore is drilled in the central axis of said spindle, 51. Both O-rings 18 remain in their previous respective locations, one on valve body 14 and the second on the front cap 41 (not shown) however said front cap is no longer vented. The stored high pressure air is still held between said O-rings 18. An additional sealing cap 91 is shown on a further extension of valve 12 allowing for balanced air feature. Both O-rings 56 are now contained within the extension of the valve body 12. The balancing air is then vented in a bore in the sliding spindle 51 into ambient air shown as 57 or alternately into the firing air 54.

Figure 8:
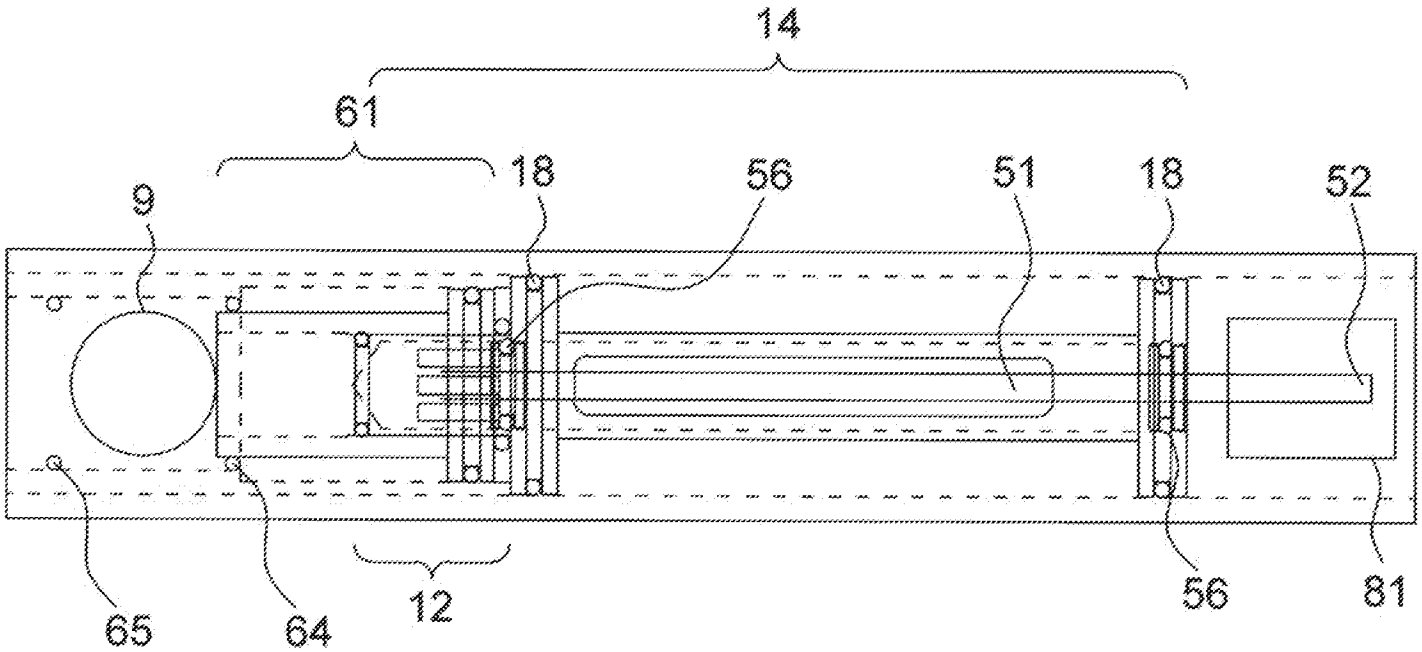
FIG. 8 is a view of one Single Central Axis version of the gun in the rest position.
Figure 9:
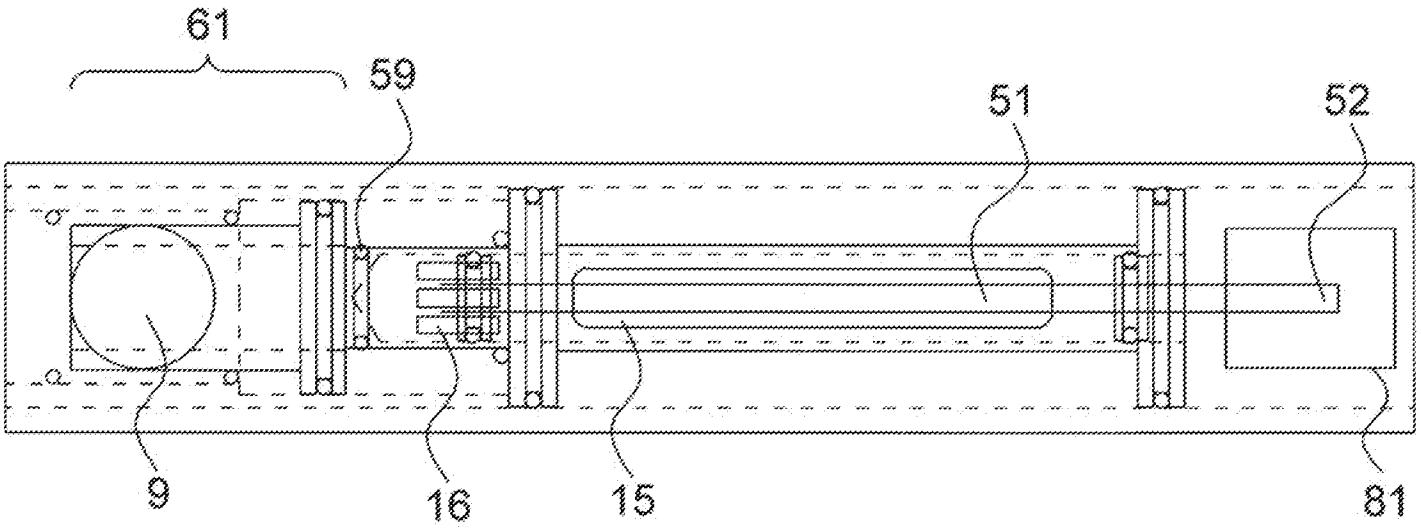
FIG. 9 is a view of one Single Central Axis version of the gun in partial firing position.
Figure 10:
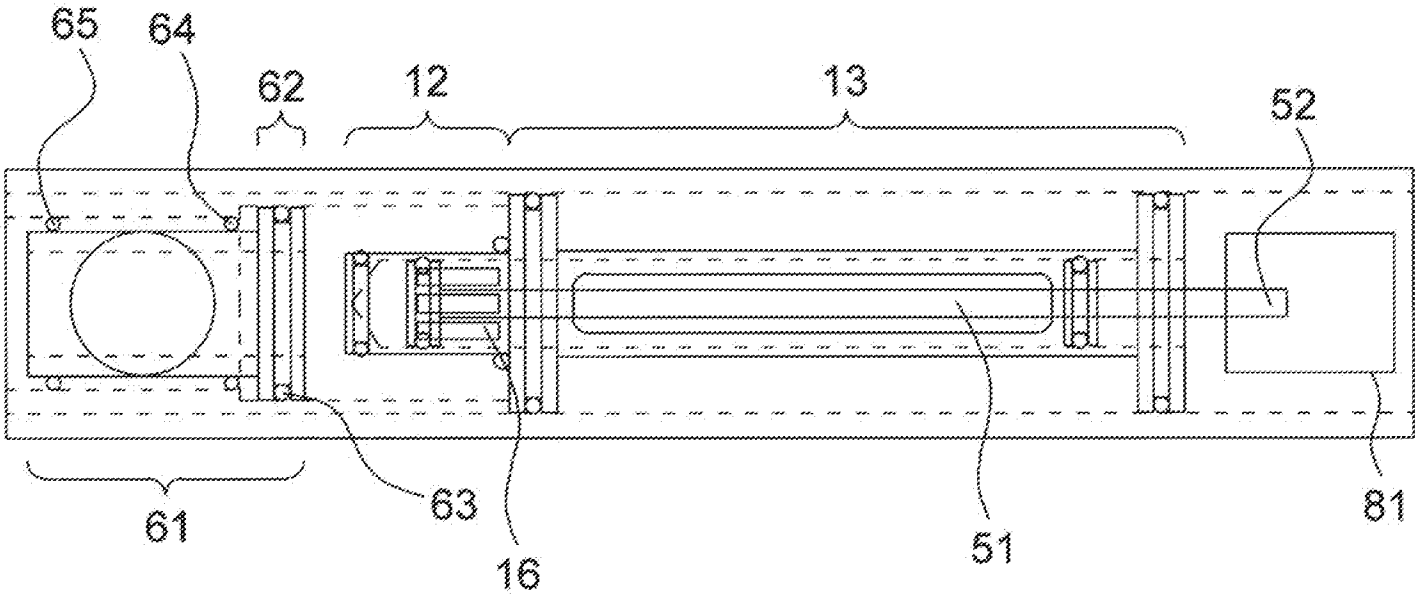
FIG. 10 is a view of one Single Central Axis version of the gun in firing position.

FIG. 8-FIG. 10 Show more precisely, the operation of a Single Central Axis configuration of the present invention. Air chamber is a fixed area located between the two O-rings 18. The sliding spindle 51, balances said high pressure air between two O-rings 56. Additionally shown is a blow forward bolt 61. This type of bolt is known in the art as a "Top Hat". Said Top Hat bolt can be preferably returned by either: a spring or pressurized air directed between O'Ring 63 of the Top Hat bolt and bolt sealing O'Ring 64.

In FIG. 8, the sliding spindle 51 of the invention is fully retracted into the valve body 14. Actuation end 52 of said spindle is fully retracted into Actuator 81. The Top Hat Bolt 61 is fully retracted and is riding on the valve body extension 12 The feed hole 9 is open to receive a paintball.

In FIG. 9, the sliding spindle 51 has partially moved forward, high pressure air is partially escaping through plurality of apertures 16, which causes the Top Hat Bolt 61 to begin forward movement. Said high pressure air is now clearing the sealing O-ring 59 on said valve body extension 12 for the central bore of said bolt 61, however said high pressure as is not fully able to flow down the central bore of said Bolt 61 to launch the ball. The feed hole 9 is closed but not past front seal.

In FIG. 10, sliding spindle 51 of the invention is fully forward. The plurality of apertures 16 are fully opened, pressurized air is fully flowing through central bore of the Top Hat Bolt 61, which is fully forward. The said bolt 61 is closed and sealing feed hole 9 by means of O-ring seals 64 and 65, and if a paintball was present it would have fired.

Figure 11:
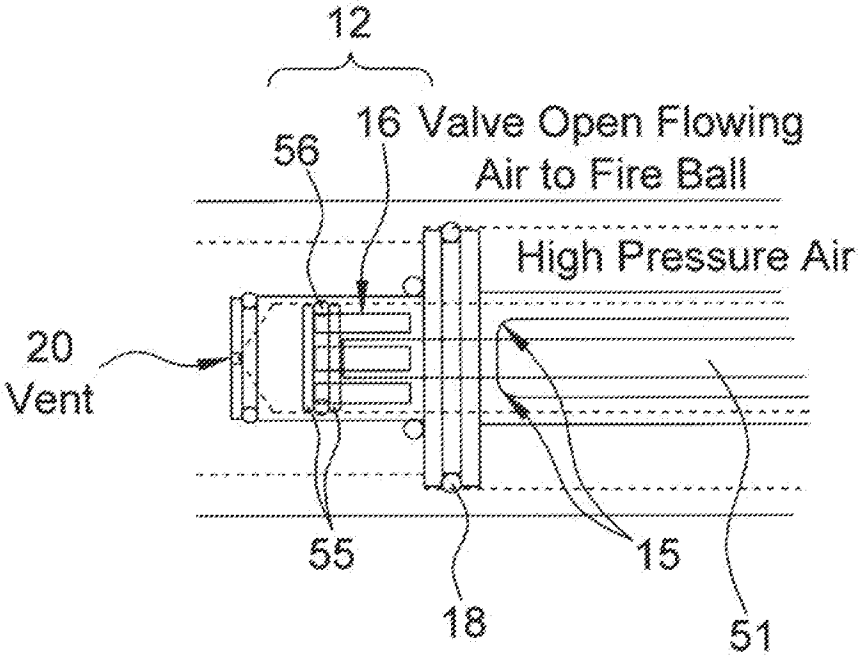
FIG. 11 is a closer perspective view of air release portion of sliding valve with its partially revealed first cylindrical portion according to the Single Central Axis presentation of present invention.

FIG. 11 more precisely discloses the escaping airflow of a Single Central Axis configuration in which high pressure air flows around sliding spindle 51 by means of a central bore 15 cut in valve body (not fully shown) feeding air to transfer grooves 16. There is a vent 20 in the valve extension 12 of valve body to allow said sliding spindle 51 to eliminate air lock allow movement. Upon said forward movement of said spindle 51, high pressure air in the gun body and held between O'Rings 18 flows through said central bore 15 of said valve body 14 and exhausting out plurality of apertures 16 to fire the paintball.

Notes:

In FIG. 8-10 the sliding spindle is shown with an undisclosed activation system 81, rather figures simply show the movement said sliding spindle 51. Said movement of said sliding spindle 51 can be accomplished in alternate ways. Examples are easily seen to include direct movement by a solenoid, movement by an air solenoid valve with attached rammer, or by mechanical movement.

FIG. 1 shows a rammer activated by a solenoid valve as the preferred embodiment of a Dual Parallel Axis configuration. An alternate embodiment of the invention for said Dual Parallel Axis configuration, and the preferred embodiment for the Single Central Axis configuration is when the actuator end of the Spindle 52, which is used to move the sliding spindle 51 of the valve assembly, is not moved the striking impact of a Rammer, but rather is moved directly by one of the coupled devices referenced in the previous paragraph.

To further clarify alternate ways a Dual Parallel Axis configuration might be configured as above, is where the movement of the bolt 71 (See FIG. 1) is no longer coupled to the ram, or linked to opening of the valve assembly 10. Rather bolt is moved by the use of a second solenoid, and where the bolt itself performs as an air powered ram pushing the ball forward and sealing the loading chamber. This said second solenoid sending pressurized air alternately to the bolt 61 to move it forwards and backwards, the opening and closing of the bolt, timed by a circuit board. The sliding spindle 51 moved by a dedicated solenoid 81. Said dedicated solenoid 81 acting on said valve assembly's sliding spindle 51, moving said sliding spindle 51 linearly by:

A) Attaching to said central spindle activation end 52 a direct acting electric solenoid. Said solenoid known in the art as a "Clapper Valve", said clapper valve's movement of its center spindle causing the movement of center spindle of the valve spindle, which in turn, causes the opening and closing of the valve assembly and the firing of the paintball.

B) Keeping the rammer with its attached air solenoid valve as shown in FIG. 1. The difference being the ram's movement is then of a decidedly shorter length because the ram's length of movement would need to be only long enough to move the sliding spindle to alternately open and close the valve assembly.

C) Another alternative is that said 5 way valve might be replace by a 3 way valve with a spring return, or in unbalanced configuration wherein the front of the ram assembly would be continuously supplied with pressurized air and the back would be selectively supplied.

While there have been shown, described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A sliding valve used in paintball guns, comprising:

a valve body comprising:

a first cylindrical portion that is in a fixed position within a gun body; and a second cylindrical portion air tightly attached to said first cylindrical portion wherein said second cylindrical portion has a smaller outer surface diameter than that of said first cylindrical portion, said second cylindrical portion having a series of apertures designed for escapement of air;

within said first and said second cylindrical portions, a central bore extending to include at least a major portion of said first and second cylindrical portions; and a sliding center spindle with various radiuses, whereon at least two pistons, containing at least two O-rings, said O-rings are configured at an outer surface of said sliding center spindle, said sliding center spindle carefully designed to slide within said central bore of said first and second cylindrical portions, one of said O-rings, alternately blocking and opening said series of apertures on said second cylindrical portion to selectively release pressured air, a second said O-ring functioning as a pressure balance to enable said sliding center spindle to slide substantially without bias within said central bore.

2. A sliding valve of claim 1 further comprising a cap opposite said cylindrical valve portions, said cap having a central bore extending to include at least a major portion of said cap, said cap containing the movement of said second air balancing O-ring of said sliding center spindle.

3. A sliding valve as of claim 2 wherein the sliding spindle is within a stored air area and more specifically within a central axis of a further extension of the valve body, past the apertures, with an affixed airtight cap placed on the said extended non-activation end of the central bore; wherein said sliding spindle is vented to outside air for balanced spindle feature.

4. A sliding valve as of claim 3 wherein said central spindle is vented to firing air to bias the valve in the closed position when firing.

5. A sliding valve as of claim 3 wherein a spring is placed between the cap and said sliding spindle to bias said spindle in a closed position.

6. A sliding valve as of claim 2, wherein said sliding valve redirects escaping air to a parallel bore containing a bolt.

7. A sliding valve as of claim 1, wherein said apertures run lengthwise on the wall of said second cylindrical portion.

8. A sliding valve as of claim 1, wherein said apertures run parallel spiral directions on the wall of said second cylindrical portion.

9. A sliding valve as of claim 1, carefully designed so that escaping air from said valve additionally blows forward a bolt located within the same central axis as said valve.

10. A sliding valve as of claim 1, wherein said sliding valve redirects escaping air to a parallel bore containing a bolt.

11. A sliding valve as of claim 1 further comprising a middle drum located on said center spindle, said drum containing at least two O'Rings, wherein said drum and said O-rings acts as an air cutoff to limit and define the air volume when the sliding spindle is in the firing position.

12. A sliding valve as of claim 1 wherein the sliding spindle allows for a spring to act upon it, to push, or at least partially push, said sliding spindle into a rest position.

13. A sliding valve as of claim 1 wherein a secondary protrusion is same dimension as said first cylindrical portion; however said gun body is recessed around said secondary protrusion to allow airflow into, or out of, said secondary protrusion.

14. A sliding valve as of claim 1 wherein a central axis of said sliding central spindle is vented to prevent air lock of sliding central spindle.

* * * * *